US008013867B2

(12) United States Patent
Higgins et al.

(10) Patent No.: US 8,013,867 B2
(45) Date of Patent: Sep. 6, 2011

(54) SYSTEMS AND METHODS FOR IMPLEMENTING IMPROVED GAMUT MAPPING ALGORITHMS

(75) Inventors: Michael Francis Higgins, Duncans Mills, CA (US); Thomas Lloyd Credelle, Morgan Hill, CA (US)

(73) Assignee: Samsung Electronics Co., Ltd. (KR)

( * ) Notice: Subject to any disclaimer, the term of this patent is extended or adjusted under 35 U.S.C. 154(b) by 369 days.

(21) Appl. No.: 11/278,675

(22) Filed: Apr. 4, 2006

(65) Prior Publication Data

US 2006/0244686 A1 Nov. 2, 2006

Related U.S. Application Data

(60) Provisional application No. 60/668,512, filed on Apr. 4, 2005.

(51) Int. Cl.
*G09G 5/02* (2006.01)

(52) U.S. Cl. ..... 345/590; 345/597; 345/600; 345/604; 345/72

(58) Field of Classification Search ..... 345/418, 345/419, 581, 589, 590, 72, 597, 600, 601, 345/603, 604, 605, 638; 382/162, 163, 167; 358/519, 520, 521, 522
See application file for complete search history.

(56) References Cited

U.S. PATENT DOCUMENTS 4,439,759 A 3/1984 Fleming et al.
4,751,535 A 6/1988 Myers
4,989,079 A * 1/1991 Ito ..... 358/520
5,311,295 A 5/1994 Tallman et al.
5,341,153 A 8/1994 Benzschawel et al.
5,398,066 A 3/1995 Martinez-Uriegas et al.
5,416,890 A 5/1995 Beretta
5,448,652 A 9/1995 Vaidyanathan et al.
5,450,216 A * 9/1995 Kasson ..... 358/518
5,657,137 A * 8/1997 Perumal et al. ..... 358/502
5,668,890 A 9/1997 Winkelman
5,694,186 A 12/1997 Yanagawa et al.
5,719,639 A 2/1998 Imamura
5,724,442 A 3/1998 Ogatsu et al.
5,731,818 A 3/1998 Wan et al.
5,821,913 A 10/1998 Mamiya
(Continued)

FOREIGN PATENT DOCUMENTS

GB 2 282 928 A 4/1995
(Continued)

OTHER PUBLICATIONS

Betrisey, C., et al., Displaced Filtering for Patterned Displays, SID Symp. Digest 1999, pp. 296-299.

(Continued)

*Primary Examiner* — Andrew Wang
*Assistant Examiner* — Abderrahim Merouan
(74) *Attorney, Agent, or Firm* — Innovation Counsel LLP

(57) ABSTRACT

Techniques for modifying aspects of the gamut mapping function in a multi-primary display system influence the performance of the display or the perception of certain ones of the colors. One embodiment of the system comprises a method for selecting a metamer. Other embodiments provide methods for modifying the output color produced by the gamut mapping operation for input colors that are on the darker or brighter surfaces of the input color gamut, or for certain out-of-gamut colors such as yellow colors.

15 Claims, 10 Drawing Sheets

U.S. PATENT DOCUMENTS

| | | | | |
|---|---|---|---|---|
| 5,864,371 | A * | 1/1999 | Nayebi et al. | 348/692 |
| 5,917,556 | A | 6/1999 | Katayama | |
| 5,917,994 | A * | 6/1999 | Perumal et al. | 358/1.9 |
| 5,929,843 | A * | 7/1999 | Tanioka | 345/600 |
| 5,933,253 | A | 8/1999 | Ito et al. | |
| 5,937,089 | A | 8/1999 | Kobayashi | |
| 5,949,496 | A | 9/1999 | Kim | |
| 5,963,263 | A | 10/1999 | Shyu | |
| 5,987,165 | A | 11/1999 | Matsuzaki et al. | |
| 5,990,997 | A | 11/1999 | Jones et al. | |
| 6,023,527 | A | 2/2000 | Narahara | |
| 6,054,832 | A | 4/2000 | Kunzman et al. | |
| 6,097,367 | A | 8/2000 | Kuriwaki et al. | |
| 6,108,053 | A | 8/2000 | Pettitt et al. | |
| 6,137,560 | A | 10/2000 | Utsumi et al. | |
| 6,141,064 | A * | 10/2000 | Nayebi et al. | 348/659 |
| 6,147,664 | A | 11/2000 | Hansen | |
| 6,183,092 | B1 * | 2/2001 | Troyer | 353/31 |
| 6,246,396 | B1 * | 6/2001 | Gibson et al. | 345/604 |
| 6,256,425 | B1 | 7/2001 | Kunzman | |
| 6,262,710 | B1 | 7/2001 | Smith | |
| 6,278,434 | B1 | 8/2001 | Hill et al. | |
| 6,297,826 | B1 | 10/2001 | Semba et al. | |
| 6,360,023 | B1 | 3/2002 | Betrisey et al. | |
| 6,384,836 | B1 | 5/2002 | Naylor, Jr. et al. | |
| 6,393,145 | B2 | 5/2002 | Betrisey et al. | |
| 6,421,142 | B1 * | 7/2002 | Lin et al. | 358/1.9 |
| 6,424,093 | B1 * | 7/2002 | Mir et al. | 315/169.3 |
| 6,453,067 | B1 * | 9/2002 | Morgan et al. | 382/162 |
| 6,459,419 | B1 | 10/2002 | Matsubayashi | |
| 6,539,110 | B2 * | 3/2003 | Myers | 382/162 |
| 6,614,414 | B2 | 9/2003 | De Haan et al. | |
| 6,633,302 | B1 | 10/2003 | Ohsawa et al. | |
| 6,657,619 | B1 * | 12/2003 | Shiki | 345/204 |
| 6,707,463 | B1 * | 3/2004 | Gibson et al. | 345/619 |
| 6,724,934 | B1 | 4/2004 | Lee et al. | |
| 6,738,526 | B1 | 5/2004 | Betrisey et al. | |
| 6,750,874 | B1 | 6/2004 | Kim | |
| 6,870,523 | B1 | 3/2005 | Ben-David et al. | |
| 6,885,380 | B1 * | 4/2005 | Primerano et al. | 345/589 |
| 6,897,876 | B2 * | 5/2005 | Murdoch et al. | 345/589 |
| 6,903,378 | B2 | 6/2005 | Cok | |
| 6,937,217 | B2 | 8/2005 | Klompenhouwer et al. | |
| 6,980,219 | B2 | 12/2005 | Higgins | |
| 7,027,105 | B2 | 4/2006 | Lee et al. | |
| 7,176,935 | B2 | 2/2007 | Higgins | |
| 7,184,067 | B2 | 2/2007 | Miller et al. | |
| 7,301,543 | B2 * | 11/2007 | Higgins | 345/589 |
| 7,412,105 | B2 * | 8/2008 | Wilensky | 382/254 |
| 2001/0040998 | A1 * | 11/2001 | Roetling | 382/162 |
| 2001/0048764 | A1 | 12/2001 | Betrisey et al. | |
| 2002/0063670 | A1 | 5/2002 | Yoshinaga et al. | |
| 2002/0085236 | A1 * | 7/2002 | Nishida et al. | 358/3.23 |
| 2003/0058466 | A1 | 3/2003 | Hoshuyama | |
| 2003/0112454 | A1 | 6/2003 | Woolfe et al. | |
| 2003/0117457 | A1 | 6/2003 | Qiao | |
| 2003/0128872 | A1 | 7/2003 | Lee et al. | |
| 2003/0151694 | A1 | 8/2003 | Lee et al. | |
| 2003/0179212 | A1 | 9/2003 | Matsushiro et al. | |
| 2003/0214499 | A1 | 11/2003 | Ohsawa et al. | |
| 2004/0021804 | A1 | 2/2004 | Hong et al. | |
| 2004/0046725 | A1 * | 3/2004 | Lee | 345/88 |
| 2004/0081318 | A1 * | 4/2004 | Bilobrov et al. | 380/201 |
| 2004/0095521 | A1 | 5/2004 | Song et al. | |
| 2004/0111435 | A1 | 6/2004 | Herbert et al. | |
| 2004/0114046 | A1 | 6/2004 | Lee et al. | |
| 2004/0222999 | A1 * | 11/2004 | Choi et al. | 345/589 |
| 2004/0239813 | A1 | 12/2004 | Klompenhouwer | |
| 2005/0024734 | A1 | 2/2005 | Richards et al. | |
| 2005/0083341 | A1 | 4/2005 | Higgins et al. | |
| 2005/0083344 | A1 | 4/2005 | Higgins | |
| 2005/0083345 | A1 | 4/2005 | Higgins | |
| 2005/0083352 | A1 | 4/2005 | Higgins | |
| 2005/0094871 | A1 | 5/2005 | Berns et al. | |
| 2005/0105147 | A1 | 5/2005 | Gruzdev et al. | |
| 2005/0152597 | A1 | 7/2005 | Spaulding et al. | |
| 2005/0212728 | A1 | 9/2005 | Miller et al. | |
| 2005/0219274 | A1 | 10/2005 | Yang et al. | |
| 2005/0225548 | A1 * | 10/2005 | Han et al. | 345/213 |
| 2005/0225561 | A1 | 10/2005 | Higgins et al. | |
| 2005/0225562 | A1 | 10/2005 | Higgins et al. | |
| 2005/0264580 | A1 | 12/2005 | Higgins | |
| 2005/0280851 | A1 * | 12/2005 | Kim et al. | 358/1.9 |
| 2008/0030518 | A1 | 2/2008 | Higgins et al. | |

FOREIGN PATENT DOCUMENTS

| | | | |
|---|---|---|---|
| WO | WO 00/42762 | | 7/2000 |
| WO | WO 01/37251 | A1 | 5/2001 |
| WO | WO 2005/050296 | A1 | 6/2005 |
| WO | WO 2005/076257 | A2 | 8/2005 |

OTHER PUBLICATIONS

Brown Elliott, C., "Active Matrix Display . . . ", IDMC 2000, 185-189, Aug. 2000.

Brown Elliott, C., "Color Subpixel Rendering Projectors and Flat Panel Displays," SMPTE, Feb. 27-Mar. 1, 2003, Seattle, WA pp. 1-4.

Brown Elliott, C, "Co-Optimization of Color AMLCD Subpixel Architecture and Rendering Algorithms," SID 2002 Proceedings Paper, May 30,2002 pp. 172-175.

Brown Elliott, C, "Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

Credelle, Thomas, "P-00: MTF of High-Resolution PenTile Matrix Displays", Eurodisplay 02 Digest, 2002 pp. 1-4.

Klompenhouwer, Michiel, Subpixel Image Scaling for Color Matrix Displays, SID Symp. Digest, May 2002, pp. 176-179.

Michiel A. Klompenhouwer, Gerard de Haan, Subpixel image scaling for color matrix displays, Journal of the Society for Information Display, vol. 11, Issue 1, Mar. 2003, pp. 99-108.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

Pollack, Joel, "Subpixel Rendering for High-Res Mobile Displays", Jan. 13, 2005, ED Online ID #9386 www.elecdesign.com.

Morovic, J., Gamut Mapping, in Digital Color Imaging Handbook, ed. G. Sharma, Boca Raton, FL: CRC Press, Dec. 2002, Chapter 10, pp. 635-682.

Murch, M., "Visual Perception Basics," SID Seminar, 1987, Tektronix Inc, Beaverton Oregon.

PCT International Search Report dated Jun. 26, 2008 for PCT/US04/33705 (U.S. Appl. No. 10/691,377).

PCT International Search Report dated May 21, 2007 for PCT/US04/33709 (U.S. Appl. No. 10/691,396).

PCT International Search Report dated Apr. 26, 2005 for PCT/US04/33743 (US Patent No. 7,176,935).

PCT International Search Report dated May 21, 2008 for PCT/US05/09536 (US Patent No. 7,301,543).

PCT International Search Report dated Jun. 21, 2006 for PCT/US05/01002 (U.S. Appl. No. 10/821,306).

Wandell, Brian A., Stanford University, "Fundamentals of Vision: Behavior . . . ," Jun. 12, 1994, Society for Information Display (SID) Short Course S-2, Fairmont Hotel, San Jose, California.

Werner, Ken, "OLEDS, OLEDS, Everywhere . . . ," Information Display, Sep. 2002, pp. 12-15.

* cited by examiner

SYSTEMS AND METHODS FOR IMPLEMENTING IMPROVED GAMUT MAPPING ALGORITHMS

CROSS REFERENCE TO RELATED APPLICATIONS

This application claims the benefit of U.S. Provisional Application 60/668,512 entitled SYSTEMS AND METHODS FOR IMPLEMENTING IMPROVED GAMUT MAPPING ALGORITHMS, filed on Apr. 4, 2005, which is incorporated by reference herein.

The following co-owned applications are related to the present application and are hereby incorporated by reference herein: (1) U.S. patent application Ser. No. 60/668,510 entitled "EFFICIENT MEMORY STRUCTURE FOR DISPLAY SYSTEM WITH NOVEL SUBPIXEL STRUCTURES," filed on Apr. 4, 2005, subsequently filed as Patent Cooperation Treaty (PCT) Application No. PCT/US 06/12768 on Apr. 4, 2006, and published in the United States as United States Patent Application Publication 200Y/AAAAAAA; (2) U.S. patent application Ser. No. 60/668,511 entitled "SYSTEMS AND METHODS FOR IMPLEMENTING LOW-COST GAMUT MAPPING ALGORITHMS," filed on Apr. 4, 2005, subsequently filed as Patent Cooperation Treaty (PCT) Application No. PCT/US 06/12766 on Apr. 4, 2006, and published in the United States as United States Patent Application Publication 200Y/BBBBBBB; (3) U.S. patent application Ser. No. 60/668,578 entitled IMPROVED METHODS AND SYSTEMS FOR BY-PASSING SUBPIXEL RENDERING IN DISPLAY SYSTEMS, filed on Apr. 4, 2005; and (4) U.S. Patent Application No. 60/743,940 entitled "PRE-SUBPIXEL RENDERED IMAGE PROCESSING IN DISPLAY SYSTEMS," filed on Mar. 29, 2006, subsequently filed as Patent Cooperation Treaty (PCT) Application No. PCT/US 06/12521 on Apr. 4, 2006, and published in the United States as United States Patent Application Publication 200Y/CCCCCCC.

BACKGROUND

The present application is related to display systems, and more particularly, to techniques for modifying aspects of the gamut mapping function in an RGBW display system to influence the performance of the display and the perception of certain ones of the colors.

In commonly owned United States Patents and Patent Applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003, novel sub-pixel arrangements are disclosed for improving the cost/performance curves for image display devices. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. proper dot inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) United States Patent Publication No. 2004/0246381 ("the '381 application") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) United States Patent Publication No. 2004/0246278 ("the '278 application") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) United States Patent Publication No. 2004/0246279 ("the '279 application") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '381, '278, '404, '277 and '741 published applications are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) United States Patent Publication No. 2003/0034992 ("the '992 application") having application Ser. No. 10/051,612 and entitled "CONVERSION OF A SUB-PIXEL FORMAT DATA TO ANOTHER SUB-PIXEL DATA FORMAT," filed Jan. 16, 2002; (2) United States Patent Publication No. 2003/0103058 ("the '058 application") having application Ser. No. 10/150,355 entitled "METHODS AND SYSTEMS FOR SUB-PIXEL RENDERING WITH GAMMA ADJUSTMENT," filed May 17, 2002; (3) United States Patent Publication No. 2003/0085906 ("the '906 application") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) United States Patent Publication No. 2004/0174380 ("the '380 application") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '992, '058, '906, '302, 380 and '297 applications and the '368 patent are hereby incorporated by reference herein in its entirety.

Improvements in gamut conversion and mapping are disclosed in commonly owned United States Patents and co-pending United States Patent Applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) United States Patent Publication No. 2005/0083344 ("the '344 application") having application Ser. No. 10/690,716 and entitled "GAMUT CONVERSION SYSTEM AND METHODS" filed Oct. 21, 2003. Each of the aforementioned '341, '352 and '344 applications and the '219 patent is hereby incorporated by reference herein in its entirety.

Additional advantages have been described in (1) United States Patent Publication No. 2005/0099540 ("the '540 application") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUB-PIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) United States Patent Publication No. 2005/0225563 ("the '563 application") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

BRIEF DESCRIPTION OF THE DRAWINGS

The organization and methods of operation of the image processing systems and techniques are best understood from the following description of several illustrated embodiments when read in connection with the accompanying drawings wherein the same reference numbers are used throughout the drawings to refer to the same or like parts.

DETAILED DESCRIPTION

Figure 1:
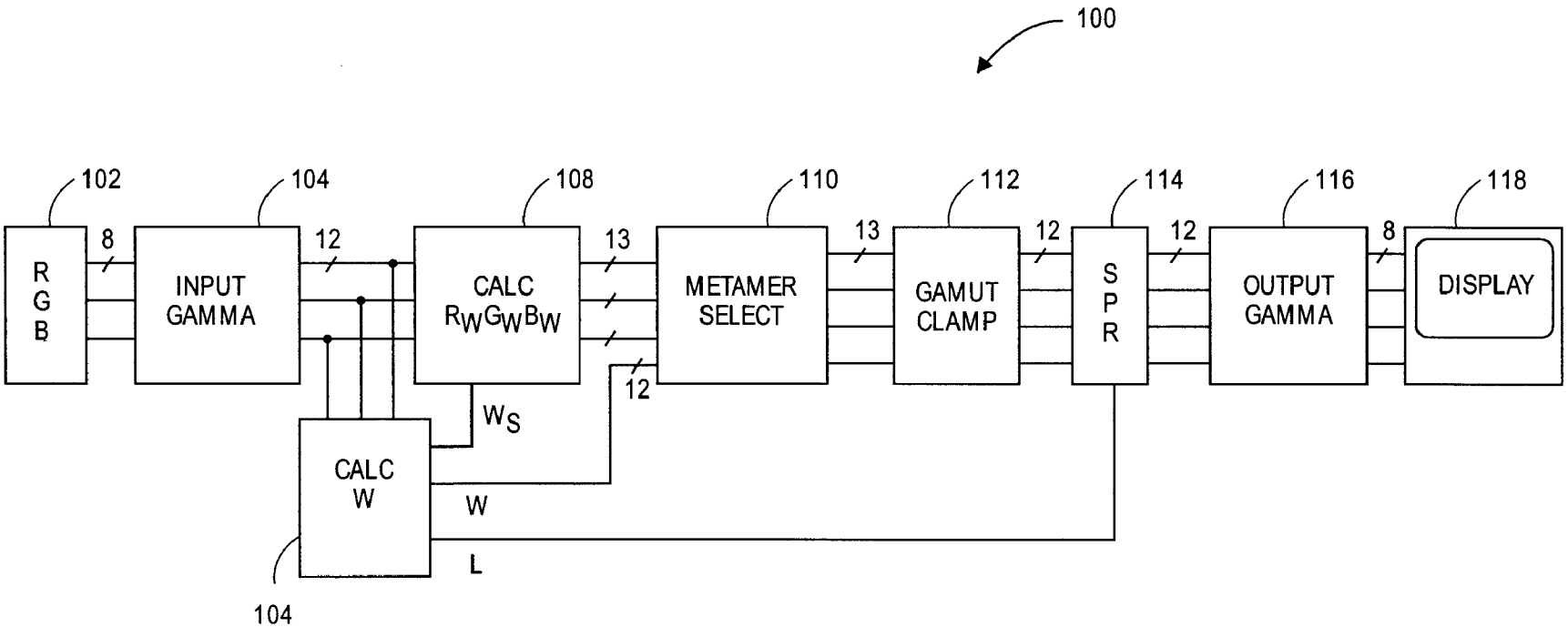
FIG. 1 is a block diagram of an embodiment of a display system in which the disclosed techniques may be implemented.

FIG. 1 shows an exemplary display system 100 which accepts red-green-blue (RGB) data input 102, and comprises input gamma module 104, and a gamut mapping (GMA) function including calculate white (W) module 104, calculate $R_W G_W B_W$ module, 108, metamer select module 110, and gamut clamp module 112. Display system 100 further includes subpixel rendering (SPR) module 114, output gamma module 116 and display 118 having a sub-pixel layout. The flow of input image data in display system 100 from input gamma module 104 through output gamma module 116 may be referred to herein as the "gamma pipeline." The gamut mapping function transforms image data from one color gamut to another. This may be a mapping from one set of RGB primaries to a second set of RGB primaries or it may be to a completely different set of primary colors. In display system 100, the GMA function transforms input color data specified in RGB primaries to a multi-primary target color space in which more than three primaries are used, such as, for example, RGBW (Red, Green, Blue, White). Other primary colors may also be used. In display system 100, the GMA function includes calculate white (W) module 104, calculate $R_W G_W B_W$ module, 108, metamer select module 110, and gamut clamp module 112. A person of skill in the art will appreciate that a display system may have configurations that differ from the embodiment shown in FIG. 1 by having fewer or different modules. Various display system embodiments are illustrated and discussed in the related applications noted and incorporated by reference above.

Techniques for Selecting Metamers

As is well known, certain types of displays (e.g. TN LCD) may be susceptible to color changes when viewed at an angle off the optimum viewing angle. One potential source of the off-axis viewing performance in a multi-primary RGBW display system occurs when the W value is very different from the color values of the remaining RGB sub-pixels. Thus, adjusting the sub-pixel values until the W and the RGB colors have values that are optimal according to certain operating parameters may improve the off-angle viewing performance of the display. Of course, such color value adjustments must be made in a manner that preserves the human perception of the color that is intended to be displayed. Such color adjustments may be accomplished using the principles of metamerism. When four or more non-coincident color primaries are used in a display, commonly called a "multi-primary" display in the art, there are often multiple combinations of values for the primaries that may give the same color value. That is to say, for a given hue, saturation, and brightness, there may be more than one set of intensity values of the four or more primaries that may give the same color impression to a human viewer, or that produce a color perception that may be substantially undistinguishable by the human eye when viewed at normal operating distances. Each such possible intensity value set is called a "metamer" for said color. Thus, a metamer on a subpixelated display is a combination (or a set) of at least two groups of colored subpixels such that there exists signals that, when applied to each such group, yields a desired color that is perceived by the human vision system. Such a signal may vary according to the group of subpixels, in order to produce the same or substantially similar perceived color.

The ability to select a color that is a metamer for another color provides a degree of freedom to adjust relative values of the primaries to achieve some effect. For subpixel rendered images, metamer choices represent a potential opportunity to select a possibly desired metamer (maybe from a set of suitable metamers) that reduces possible errors between the desired and actual image displayed. RGBW systems are one example of display systems that may take advantage of these degrees of freedom. A GMA function that transforms an input color to a color space with four or more colors provides the ability to choose different metamers for the input color, and thus provides an extra degree of freedom to adjust the subpixel values until the W and the RGB have values that are optimal according to certain operating parameters, while still producing the same color in the transform color space, such as the CIE XYZ color space.

Some prior art methods base a metamer selection process on changing (e.g. increasing or decreasing) the W component by an average of the signal values of the R, G and B components. However, in some cases, this strategy is not optimal. For example, in some regions of an image (e.g. a face or other skin tones, or otherwise a pink region), the W component should ideally track with the R component. If the W and R component (i.e. the brightest of the colored primaries in that region) do not track their signal values well enough, then off-axis viewing may produce a noticeable and possibly objectionable color shift. The same argument applies in other regions where the brightest colored primary is other than R (e.g. G or B).

In some display implementations, therefore, it is advantageous to minimize the difference in signal values between the W component and the brightest one of the colored primaries. The set of formulae in Equations 1 and 2 below effect such a metamer selection.

In the set of equations labeled Equations 1 below, $R_W$, $G_W$ and $B_W$ designate the color for which a metamer is to be chosen, and $R_2$, $G_2$ and $B_2$ designate the metamer. When one of the primaries in a metamer is changed by an amount "a", one might change each of the other primaries by an amount (a*m)—where the 'metamer slope' term "m" may be different for each of the primaries. The "m" slope terms may be calculated from a matrix denoted M2X that converts colors from the multi-primary system into CIE XYZ co-ordinates; such conversion matrices are described, for example, in US Patent Applications 2005/0083341 and 2005/0083352. Equations 1 show that a small amount "a" is added to W. Small amount "a" is modified by multiplying by slope values "m" before adding to each of $R_W$, $G_W$ and $B_W$. The "m" values may sometimes be negative for RGBW, and are often slightly different values for each of R G and B, shown by designating the "m" slope values with subscripts in Equations 1.

$$W_2 = W + a$$

$$R_2 = R_W + a * m_R$$

$$G_2 = G_W + a * m_G$$

$$B_2 = B_W + a * m_B \qquad \text{Equations 1}$$

If one carefully measures the colorimetry of a display and were to build a conversion matrix, then the "m" values will usually all have different values. In some cases, the "m" values may have very different values. This occurs in display systems having five or more colored primaries, or in four color primary systems not involving W.

Figure 2:
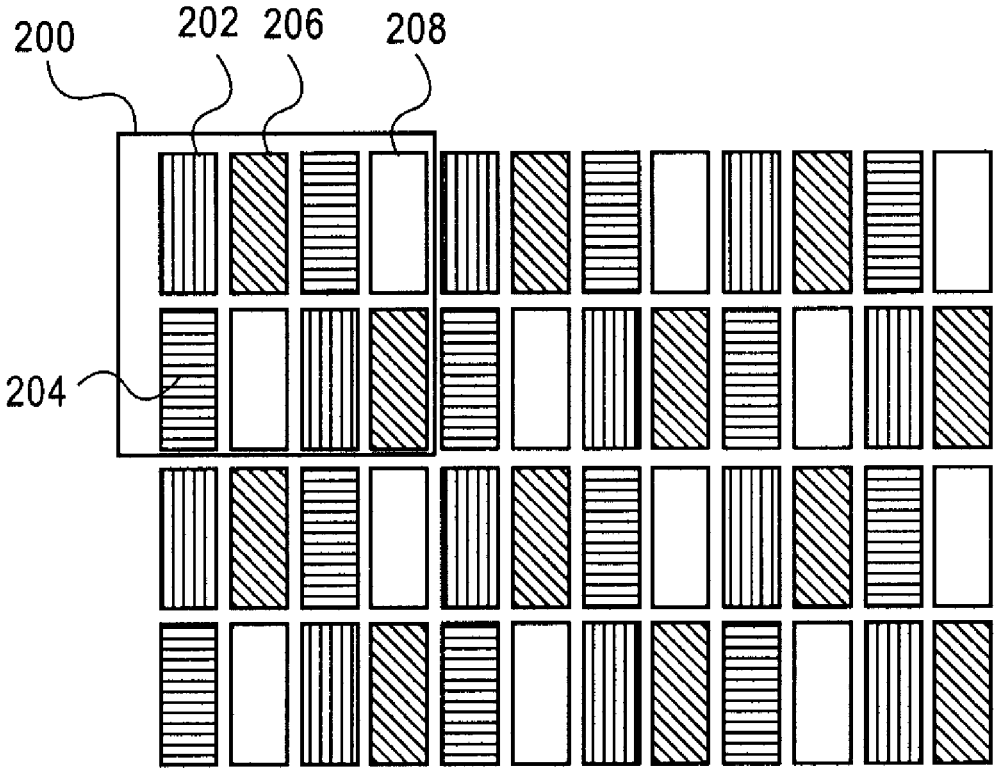
FIG. 2 illustrates an example of a novel subpixel layout for a display that may be employed in the display system of FIG. 1.

For example, FIG. 2 is an example of a display panel comprising a subpixel layout including sub-pixel repeating group 200. Group 200 comprises a first checkerboard of red 202 and blue 204 subpixels and a second checkerboard of green 206 and white 208 subpixels. Note that in all figures showing subpixel layouts, the same hatching patterns denote the same color assignments of red shown by vertical hatching, blue shown by horizontal hatching, green shown by diagonal hatching. Subpixels shown with no hatching, such as subpixel 208, indicate white, and in some subpixel layout embodiments may also indicate grey or another color, such as yellow. In an embodiment using the sub-pixel layout of FIG. 2 for an RGBW system, it is possible to make simplifying assumptions that result in conversion Matrix 1.

$$\begin{pmatrix} 0.5 & 0 & 0 & 0.5 \\ 0 & 0.5 & 0 & 0.5 \\ 0 & 0 & 0.5 & 0.5 \end{pmatrix} \qquad \text{Matrix 1}$$

One assumption which can be made for the sub-pixel layout of FIG. 2 for an RGBW system is that the W sub-pixel contributes as much luminosity to the image as the color sub-pixels combined. Such an assumption may hold as well for a grey or wideband yellow subpixel in place of a white or unfiltered subpixel. Using this assumption, the "m" values are all substantially identical and reasonably close to minus one. This reduces hardware complexity and results in lower implementation costs.

When the "m" values are all substantially identical and reasonably close to minus one, Equations 1 may be modified as shown in Equations 2. These steps may reduce the difference between W and the brightest color primary while keeping the desired perceptual color $R_W G_W B_W$ substantially the same.

(1): $a=(\max(R_W,G_W,B_W)-W)/2$ (2): $a=\min(a,R_W,G_W,B_W)$ (3): $W=W+a$ (4): $R_W=R_W-a$ (5): $G_W=G_W-a$ (6): $B_W=B_W-a$ Equations 2

Line 1 of Equations 2 computes a quantity "a" as half of the difference between the maximum of the $R_w$, $G_w$ or $B_w$ values and the W value. Other ratios may also be suitable. This value may be 12 bits wide or less depending on system design; "a" may be a positive or negative value, so it is possible to use a $13^{th}$ bit (or other high bit) to store the sign. It is possible to have the hardware compare, add or subtract this signed number as in the following lines of Equations 1.

Line 2 tends to limit the maximum size of quantity "a", so that it may not produce negative out-of-gamut values in the last three lines of Equations 2.

Line 3 calculates a new W value that may be substantially identical or possibly closer to a maximum primary value by adding the corrective "a" value. This addition tends to prevent a W value from going out of gamut, so W may remain a 12 bit number and may not need to be tested for out-of-gamut later. Lines 4, 5 and 6 subtract the corrective "a" value from each of the primaries.

Figure 3:
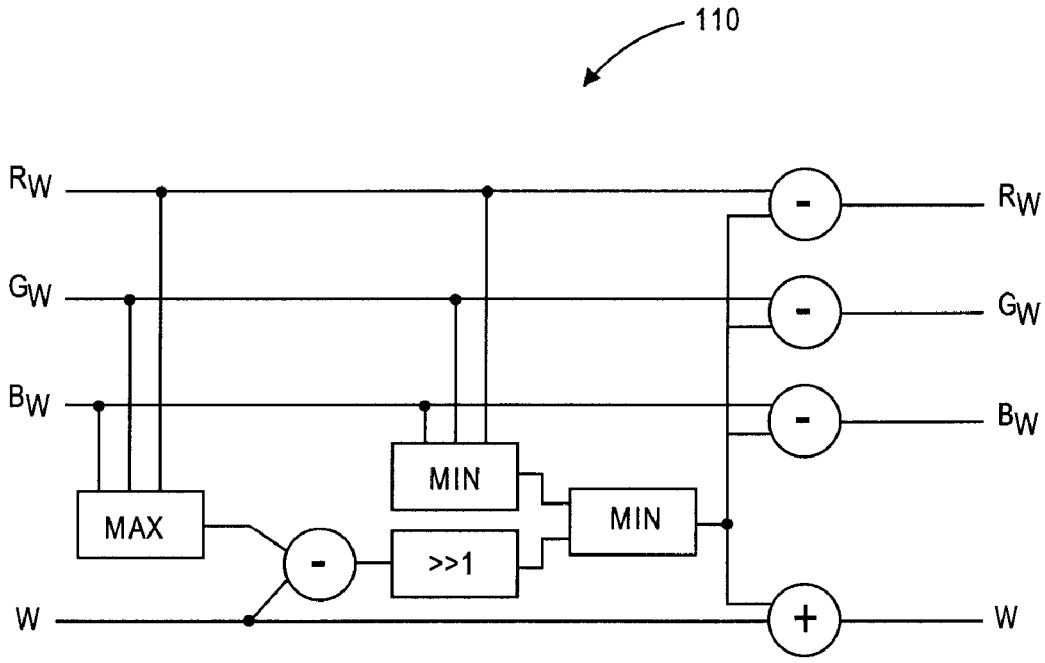
FIG. 3 is a detailed diagram of an embodiment of the metamer select module from FIG. 1.

FIG. 3 depicts one implementation of the metamer selection procedure shown in Equations 2 above. Other metamer selection procedures are also possible. This metamer selection procedure may be incorporated into a display system, for example as metamer select module 110 of FIG. 1.

Several techniques will now be discussed for altering the processing flow of the Gamut Mapping operation to accommodate certain categories of input colors or under certain color conditions. In particular, techniques will be discussed for handling input colors at or near the "lower" or "darker" surface of the input color gamut; input colors at or near the "higher" or "brighter" surface of the input color gamut; and bright yellow colors.

Low Cost Implementations of a "Low Bypass" Gamut Mapping Operation

Figure 11A:
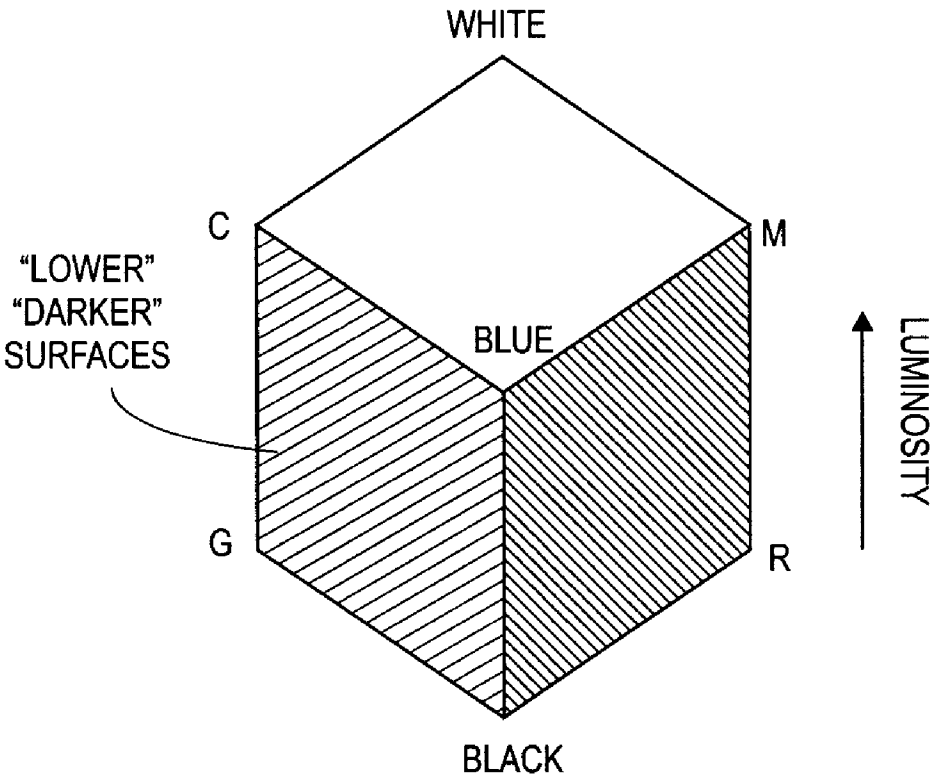
FIGS. 11A-11B are diagrams of the lower and upper surfaces of a color gamut.

FIG. 11A illustrates a color gamut showing the "lower" and "darker" surfaces. The gamut mapping operation may be modified as colors approach the "lower" or "darker" surface of the input color gamut. One implementation of a simplified GMA operation passes the RGB color values through unchanged and sets W to zero. Another passes the RGB color values through unchanged and sets W to the minimum of R, G and B. Either of these would tend to make "ramps to black" processing have a linear change in color instead of a nonlinear performance; some people may find this characteristic objectionable in a RGBW gamut mapping operation. A test pattern with a linear ramp from black to solid red, for example, may have a non-linear ramp after GMA processing. This behavior is usually not noticeable in the human visual system, but may create unexpected results in measurements of test patterns.

Figure 4:
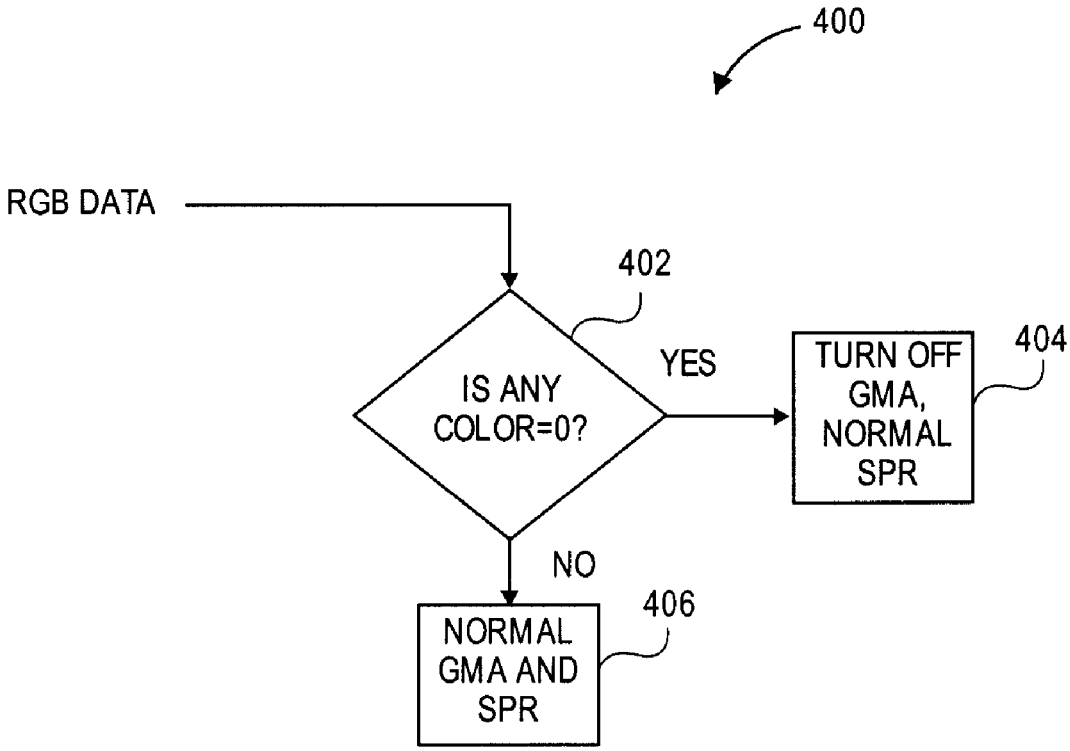
FIG. 4 is a flow chart of one embodiment of a simple bypass mode.

The flowchart of FIG. 4 illustrates low bypass function 400 in which an adaptive test will selectively turn off the GMA when any color lies along the lower dark surfaces of the color gamut. These colors lie between black and the fully saturated colors. To detect when Low Bypass is applicable, block 402 tests for the condition that one or more color primaries are equal to zero. Under this condition, block 404 shows that the GMA circuitry is turned off and only SPR will be active. Otherwise, normal GMA and SPR may proceed as in block 406. In these cases, a full gray ramp in color will be achieved and all levels of color, e.g. 256 levels for an 8 bit system, will be displayed. A variation of low bypass function 400 modifies test 402 to test for any color less than or equal to some preset threshold. This will bypass the gamut mapping operation for colors near the dark surfaces of the color gamut as well as those that lie on the dark surfaces.

"Low Bypass" GMA Variations: "Soft Low Bypass"

Implementation of Low Bypass function 400 of FIG. 4 may introduce banding in some images as colors slowly approach the threshold. To prevent banding, a "feathering" function (denoted as $fl$) may be employed when a color approaches the "lower" or "darker" surfaces of the input color gamut. Feathering function $fl$ may tend to zero when the input color being converted is a certain threshold distance away from these dark surfaces. Feathering function $fl$ is used to calculate a weighted average between an embodiment of the simpler GMA (e.g., a variation of Low Bypass) and the full RBG-to-RGBW gamut mapping operation. Table 1 provides pseudo-code for an implementation of feathering function, $fl$. In this example, $fl$ is calculated so that it has a value of some suitable number in an 8-bit system. In Table 1, the value of sixteen (16) is used.

TABLE 1

Pseudo-Code Embodiment 1 for Feathering Function, fl

```
int fl = 16 − min(r_i, min(g_i,b_i));      //feathering function
if (fl > 0)                                //only do low bypass in this range
{   fl = fl*fl/16;                         //square the feathering function
    R = (fl*r + (16 − fl)*R)/16;           //feather in Rw
    G = (fl*g + (16 − fl)*G)/16;           //feather in Gw
    B = (fl*b + (16 − fl)*B)/16;           //feather in Bw
    W = ((16 − fl)*W)/16;                  //feather W to zero   }
```

In these formula, the values $r_i$, $g_i$ and $b_i$ are the input values before applying input gamma operation 104 (FIG. 1), so these values may range from 0 to 255 in an 8 bit display. The values r, g and b are the input values after input gamma operation 104 but before the GMA operation. R, G, B and W are the output values after gamut clamping operation 112 (FIG. 1). When $fl$=16, the input RGB values may be bypassed through to the output and W might be zero. When $fl$=0, the RGBW GMA values are used unchanged. In between the $fl$ values 0 and 16, RGB color values may be calculated.

Figure 5:
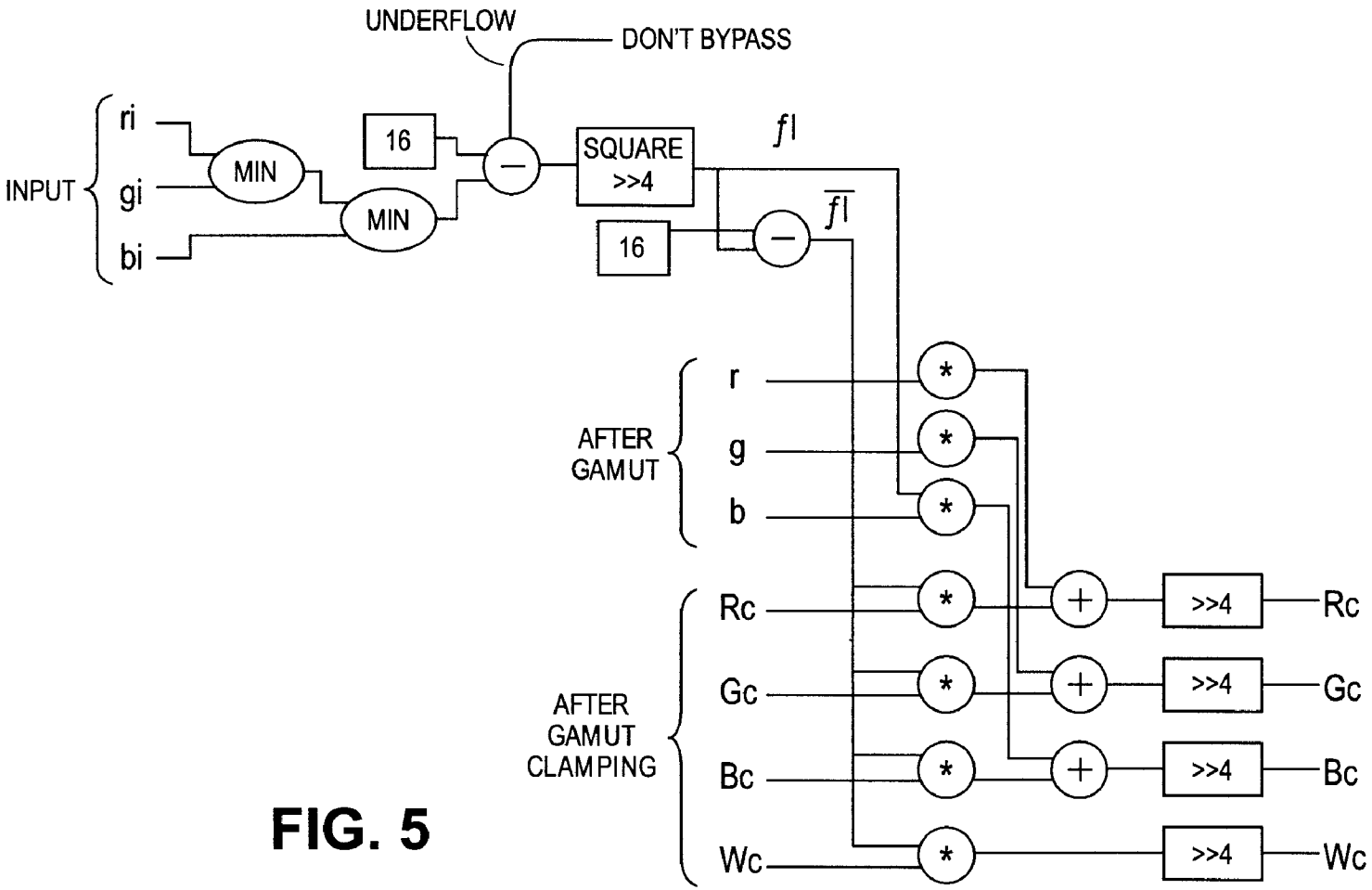
FIG. 5 is a diagram illustrating one embodiment of a first bypass module for a simplified gamut mapping operation.

FIG. 5 is a diagram illustrating an implementation of feathering function $fl$ described in Table 1; it is to be understood that variations of and alternatives to the implementation of FIG. 5 are possible. Some considerations of a hardware implementation are now discussed. In this implementation, feathering function $fl$ is a number between 0 and 16, which just barely requires 5 bits of precision. It might be desirable to keep $fl$ in 4 bits, but this prevents the function from ever reaching a weight value of 1.0. In a variation of this implementation, the 5th bit of $fl$ is used as an overflow that bypasses the multipliers completely, since this is the case of multiplying by 1.0. This variation would keep the multipliers smaller and the gate count down. In Table 1 and FIG. 5, feathering function $fl$ is squared. This squaring of $fl$ could be done with a 4×4 multiplier or a small look-up-table. An alternate implementation may choose to apply to $fl$ a function with a slope near zero where it ends. Such a function may help to prevent a rapid change in the slope of color ramps and a more visible perceptual change. In Table 1 and FIG. 5, some values are multiplied by $fl$ and others are multiplied by (16-$fl$). There may be some optimization possible to calculate this "inverse $fl$" value in the hardware. The after-gamut clamping values R, G, B and W may be used in the implementation in FIG. 5 because these have been reduced back to 12 bits from 13, making the multipliers 12*4 bits. Note that it may be desirable to keep the 16 bit intermediate results until after the add function.

"High Bypass" Gamut Mapping Operation

Figure 11B:
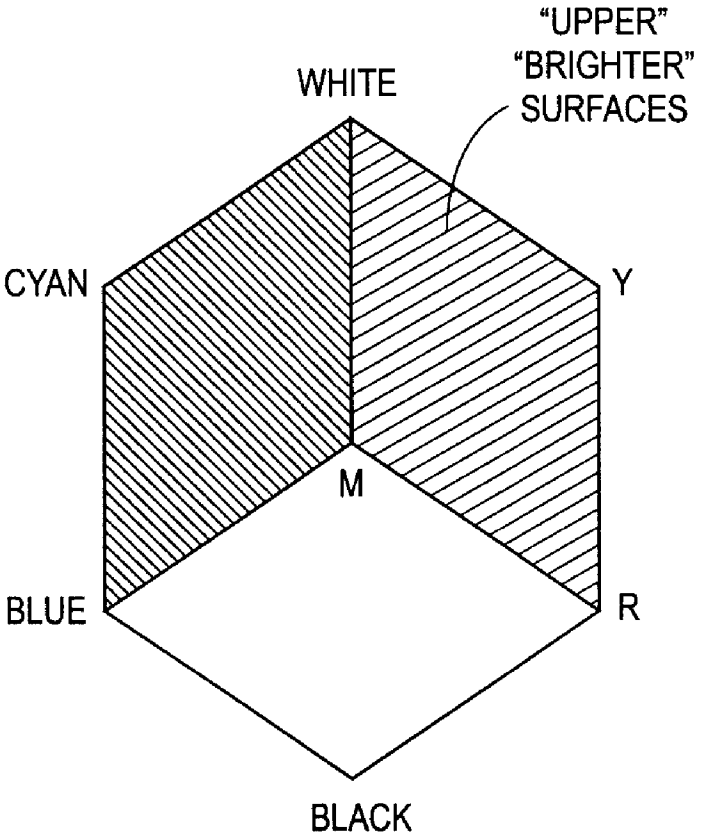

The Low Bypass methods and techniques described above do not address the class of colors that lie on the bright "upper surfaces" of the gamut, as depicted in FIG. 11B. These are typically colors between the saturated colors and white. The GMA processing of the techniques described above would tend to make "ramps to white" have a non-linear change in color instead of a linear performance. Some people might find this non-linear change objectionable in a RGBW GMA. A test pattern with a linear ramp from solid red to white, for example, will have a non-linear ramp after GMA processing. This behavior is usually not noticeable in the human visual system, but can create unexpected results in measurements of test patterns.

The simplified GMA operation that handles the class of colors that lie on the bright "upper surfaces" of the gamut is referred to herein as "High Bypass" and adds small values to the W output on out-of-gamut colors near the "upper" or "bright" surfaces of the input gamut. The amount added is a function of the distance that a color is out-of-gamut and a function of how close the color is to the upper surface of the gamut. Below is one embodiment of this High Bypass.

TABLE 2

Pseudo-Code Embodiment 1 for High Bypass Function, fu

```
int fu = max(r_i, max(g_i,b_i)) − 239;   //feathering function
if (fu > 0)                              //only do low bypass in this range
{                                        //add calculated value to W
W = W + ((scale − RNGCOL) * W * 2 / RNGCOL) * fu/16;   }
```

In a display system, these calculations may be executed when it is known that a color is out-of-gamut (OOG). In the hardware, this might mean this logic may have to be added inside the gamut mapping module 112 of FIG. 1, but perhaps only on the path where the clamping logic is selected, as described in one of the applications incorporated by reference above.

High Bypass feathering function $fu$ is similar to Low Bypass feathering function $fl$. Feathering function $fu$ is a number between 16 and 0 in this illustrated embodiment and is calculated from the input $r_i$, $g_i$ and $b_i$ values before applying input gamma. RNGCOL, indicating the range of colors, is $2^{12}$ or 4096 in the case of a system with 12 bit internal calculations. The calculation (scale−RNGCOL) may simply be the lower 12 bits of the maximum out-of-gamut value. This is the same as the input to the INV (inverse) LUT in the hardware specification of the above referenced patent applications. The W value after gamut clamping may be multiplied by this index. Finally this product is added to the after clamping W value.

Figure 6:
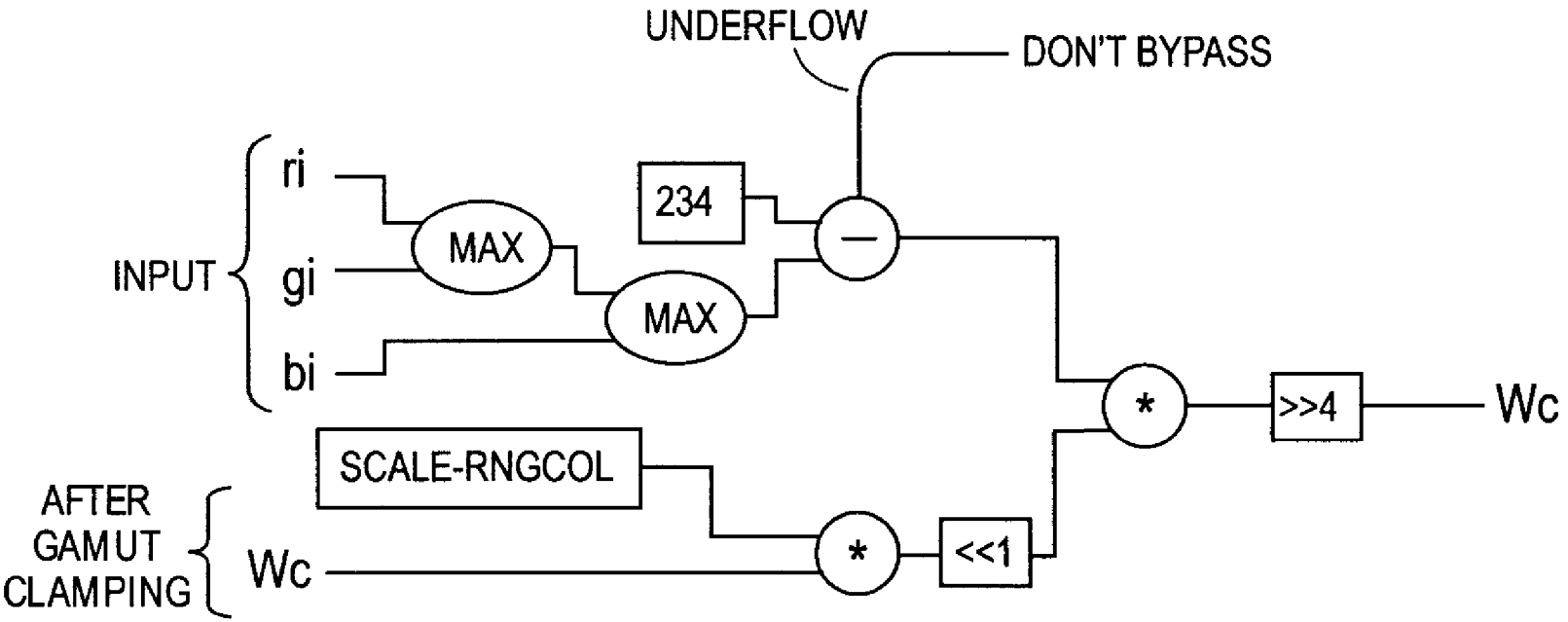
FIG. 6 is a diagram illustrating one embodiment of a second bypass module for a simplified gamut mapping operation.

FIG. 6 shows one hardware implementation of high bypass feathering function $fu$ described in Table 2; it is to be understood that variations of and alternatives to the implementation of FIG. 6 are also possible. Some considerations of the hardware implementation are now discussed. In this implementation, feathering function $fu$ is a number between 0 and 16 and has the same 4 to 5 bit optimization in the multiplier as discussed above in relation to the low bypass feathering. In this implementation, a 12*12=12 bit multiplier (12 bit number times 12 bit number saving only the upper 12 bits of the result) would be used. It should be noted that the result is multiplied by two, so some optimization in the multiplier might be possible. However, multiplying by other constants, for example by one, may also produce a useful result. The resulting number, even after multiplying by two, may thus fit in 12 bits. Then it is multiplied by the feathering function and immediately divided by 16, so a 12*4=12 bit multiplier may be used when the special case of $fu$=16 is handled as a separate special case. The product from multiplying by the feathering function $fu$ is added to the after clamping W value, and the result of the addition may not overflow 12 bits.

Smaller Bit Depth Embodiments:

Throughout the above discussion, the input color primaries were assumed to be 8 bit inputs and the internal gamma pipeline was assumed to be 12 bits. Another common hardware design has 6 bit inputs and a 10 bit internal pipeline. The above equations may be modified to work in a reduced bit configuration. Thus, the equations below will pertain to the case of 6 bit in and 10 bit internal as an example and other systems are likewise possible. The metamer select formulas of Equations 1 and 2 may not need to change as the bit sizes decrease.

Table 3 shows a second pseudo-code embodiment for feathering function $fl$ when $fl$ is limited to range in value from 0 to 4 in a 6 bit input implementation.

TABLE 3

Pseudo-Code Embodiment 2 for Feathering Function, fl

```
int fl = 4 − min(r_i, min(g_i,b_i)); //feathering function
if (fl > 0)                          //only do low bypass in this range
{   fl = fl * fl/4;                  //square the feathering function
    R = (fl * r + (4 − fl) * R)/4;   //feather in R_w
    G = (fl * g + (4 − fl) * G)/4;   //feather in G_w
    B = (fl * b + (4 − fl) * B)/4;   //feather in B_w
    W = ((4 − fl) * W)/4;            //feather W to zero   }
```

Similarly, feathering function $fu$ may range from 0 to 4 in the High Bypass calculations, and the value of RNGCOL may change from 4096 in a 12 bit gamma pipeline to 1023 in a 10 bit pipeline:

TABLE 4

Pseudo-Code Embodiment 2 for High Bypass Function, fu

```
int fu = max(r_i, max(g_i,b_i)) − 59;   //feathering function
if (fu > 0)                             //only do high bypass in this range
{                                       //add calculated value to W
W = W + ((scale − RNGCOL) * W * 2 / RNGCOL) * fu/4;      }
```

Gamut Mapping Operations for Handling Yellow

Solid yellow areas on RGBW displays tend to have a "golden" appearance that some observers find displeasing. Techniques for improving the appearance of these solid yellow areas will now be described.

Making the yellow areas of an image brighter may tend to remove or improve the "golden" appearance. Increasing the value of the W sub-pixel in yellow areas may make yellow areas brighter. In display system 100 of FIG. 1, the gamut mapping operation components 104, 108 and 110 typically generate a white (W) value for yellow colors that is in the gamut of the RGBW color space. Thus, increasing the value of the W sub-pixel in yellow areas is not likely to result in an out-of-gamut color value. In the case of yellow colors, then, gamut mapping processing may be modified to bypass gamut clamping operation 112 (FIG. 1) on W when the color is near yellow, while continuing to clamp $R_w$, $G_w$ and $B_w$. This results in an enhanced W value, and thus extra brightness and decreased saturation. The following pseudo-code shows one embodiment of yellow bypass:

TABLE 5

Pseudo-Code Embodiment for Yellow Bypass Function, fl

```
if (B_C < min(R_C, G_C))            //are we "near yellow"?
{    fl = abs(R_C − G_C) >>4        //feathering function
     W_C = (W_C * fl)>>8 + (W * (255 − fl))>>8    //bypass W clamping }
```

In Table 5, $R_C$ $G_C$ $B_C$ and $W_C$ specify color values after gamut clamping. The first step is to determine when the color is "near yellow". Boolean test $B_C<\min(R_C,G_C)$ is one embodiment that detects when a color is inside the yellow chromaticity quadrangle bounded by lines on a chromaticity diagram between the four points of Red, Yellow, Green and White. If this Boolean is false, the color may not be in the yellow quadrangle and the clamped $W_C$ value may be passed through unchanged. The test for less than (instead of less than or equal to) may tend to avoid colors near white and black. This is still a large volume of colors and there would be an abrupt change at the edges which would be visible in many images. To avoid this problem the change from clamped $W_C$ to unclamped W is feathered. The closer the color value is to the line of yellows the more unclamped W is used and the less clamped $W_C$ is used. Feathering calculation $fl=abs(R_C-G_C)>>4$ generates a value between 0 and 255 on a display with 12 bit internal calculations. When $fl$ is zero, the color is substantially on the line of yellows. When $fl$ is 255, the color is considerably far away from yellow but still inside the yellow quadrangle. This $fl$ value may be used to calculate a weighted average of the W and $W_c$ values.

Figure 7:
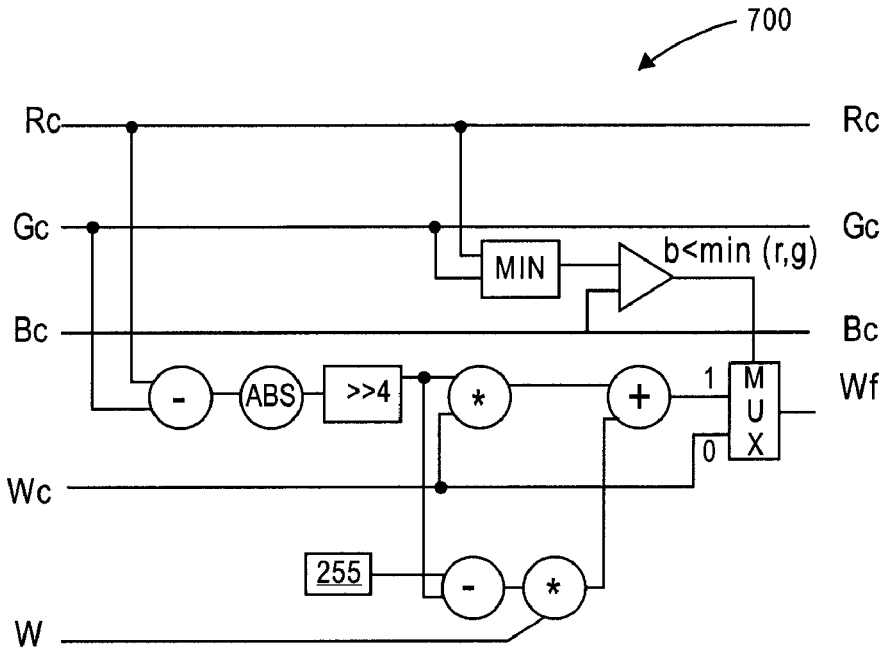
FIG. 7 is a diagram illustrating one embodiment of a third bypass module for a simplified gamut mapping operation.

FIG. 7 shows an embodiment of a hardware implementation 700 of the yellow bypass function. With an 8 bit $fl$ value and a 12 bit gamma pipeline (FIG. 1), the multipliers would be 12*8 bits giving a 20 bit result. Since the lower 12 bits are immediately discarded, it should be reasonable to do some optimizations in the hardware. A 12*8=12 multiplier (12 bits times 8 bits giving a 20 bit result then discarding the lower 8) would suffice. This is similar to the 13*8=12 multipliers already implemented in the gamut clamping module as described in the above referenced patent applications.

Figure 8:
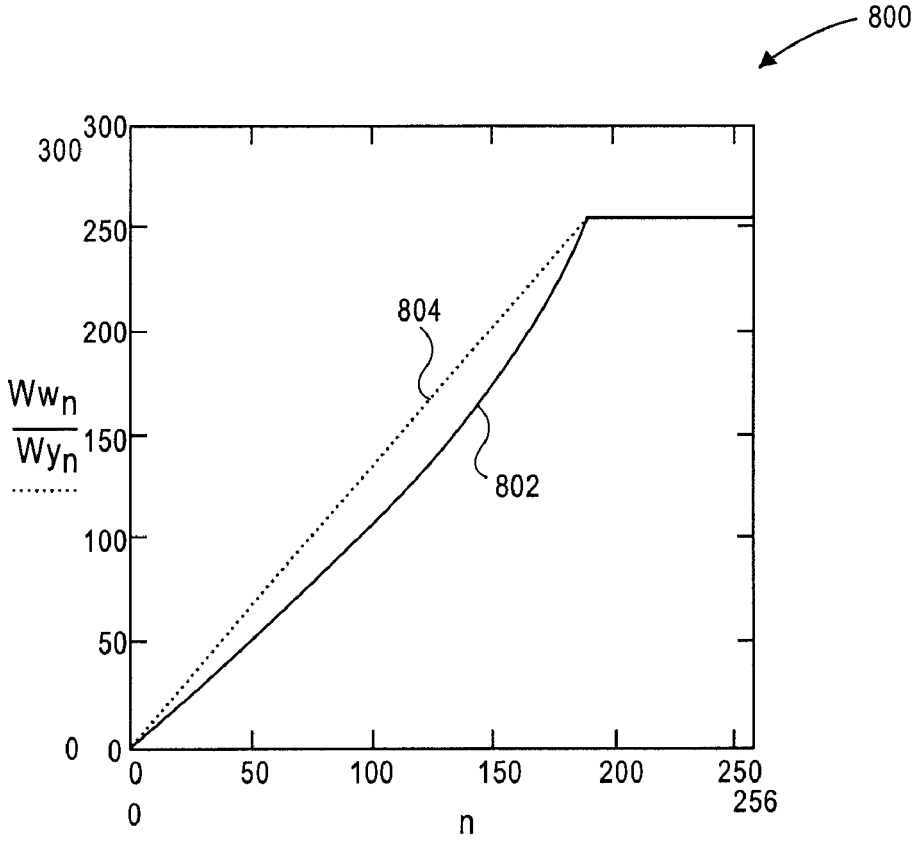
FIG. 8 is a diagram of the processing effects of the module of FIG. 7.

FIG. 8 is a chart 800 showing the results of an input ramp that goes from yellow to white. Line 802 shows the values of W when the yellow bypass function is not applied, and line 804 shows the W values that result when the yellow bypass function is applied.

Another technique for improving the appearance of solid yellow areas in an image involves decreasing the saturation of yellow colors, which should also make yellow areas brighter. This technique is generally referred to herein as "yellow de-saturate." This method causes W to be introduced before reaching fully saturated input yellow. This tends to desaturate more yellow areas, but may produce a brighter yellow that many observers prefer.

Figure 10:
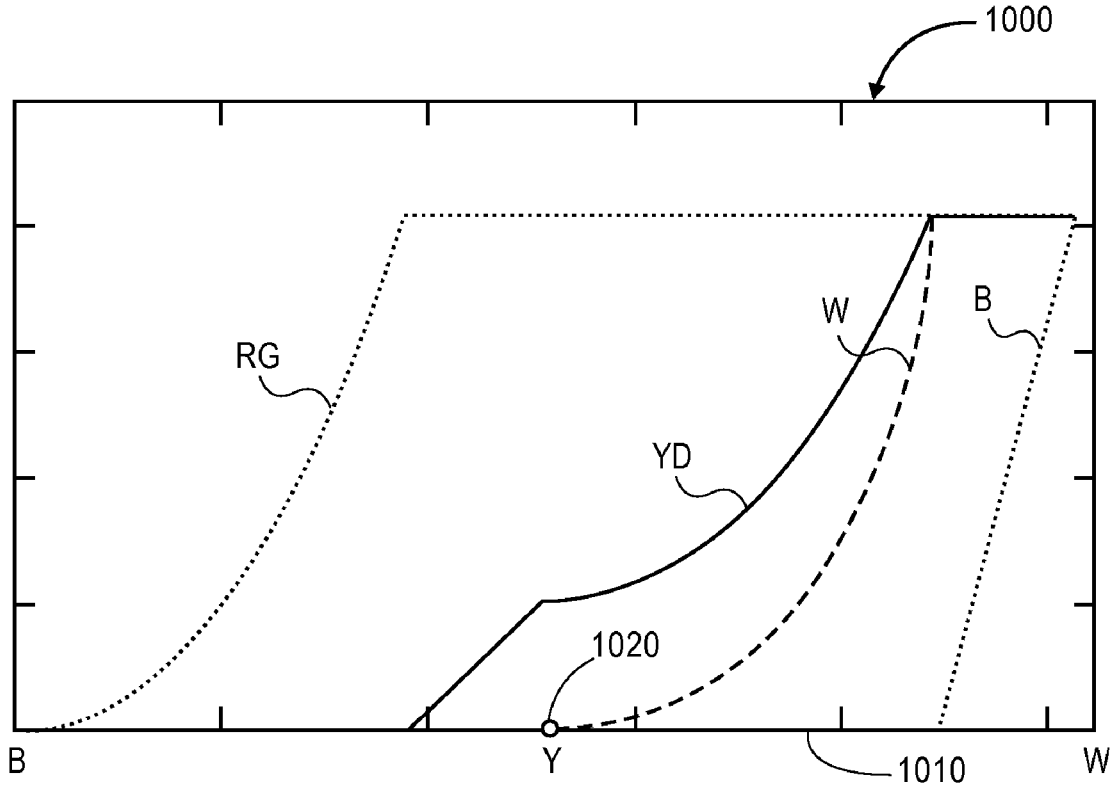
FIG. 10 is a diagram of the processing effects of the module of FIG. 9.

FIG. 10 shows the old and new behavior of RGBW in this embodiment. FIG. 10 illustrates graph 1000 having axis 1010 labeled B (black) at the left edge, Y (yellow) in the middle and W (white) at the right edge. Graph 1000 shows a ramp from black on the left to yellow in the middle followed by a ramp from yellow to white on the right. Line RG shows the behavior of Red and Green which tend to rise together from zero to the maximum value to produce yellow then remain constant. Line W, which shows the behavior of W before applying the yellow de-saturate procedure, starts to rise in the middle as the color ramp starts to head from yellow to white. When W reaches the maximum value, it remains there. Line B shows how Blue starts to rise and reaches the maximum value at white. Line YD shows a new improved behavior of W that produces a desirable de-saturation of yellows in images. It is desirable because it makes yellows brighter and removes a "golden" look in the yellows. The YD line shows W rising before the yellow ramp gets to point 1020 indicating solid yellow in the middle of the graph. In the second half of the graph the YD line continues to rise in a manner similar to the original behavior in line W but offset and scaled.

In the above referenced patent applications describing the RGBW gamut mapping (GMA) functionality, there is the possibility of colors being out of gamut (OOG) and being brought back into gamut. When colors are in gamut, this is the area of FIG. 10 from the left edge to the start of the YD line. If there are no OOG colors, the value of W need not be changed; that is, the yellow de-saturate function need not be applied. Only when colors are OOG is a change in the calculation desirable. Table 6 contains the pseudo-code for one embodiment of the yellow desaturate technique:

TABLE 6

Pseudo-Code Embodiment for Yellow Desaturate Function

```
If (OOG)    // only do yellow desaturate when out-of-gamut
    {       //calculate how far red and green are OOG
    ROOG = if (R_W>=RNGCOL) RNGCOL-R_W else 0;
    GOOG = if (G_W>=RNGCOL) RNGCOL-G_W else 0;
    WOOG = (ROOG+GOOG)/2        //feathering function
                                //feather in the yellow-desaturate
    W_C = W_C + WOOG/4 + W_C*WOOG/RNGCOL    }
```

The variable "OOG" in Table 6 indicates a flag that is set to indicate that one or more of the $R_W$, $G_W$, $B_W$ and W values is out of gamut. In this implementation, color values $R_W$, $G_W$, $B_W$ and W produced by calculate modules 104 and 108 (FIG.

1) are clamped in gamut clamp module 112 (FIG. 1), which produces clamped values $R_C$, $G_C$, $B_C$ and $W_C$, and sets flag OOG when one or more of the values is out of gamut. If the OOG flag is set, then the yellow desaturate procedure of Table 6 is performed. The amount that red is out-of gamut (ROOG) and the amount that green is out-of gamut (GOOG) are each calculated by testing the $R_W$ and $G_w$ color values against the value of RNGCOL. RNGCOL, the range of colors, is the maximum value a color may have and still be in gamut, plus one, and equals $2^{12}$ for a system with 12 bit internal calculations. In the hardware, this test is straightforward to do since the $13^{th}$ bit of $R_W$ and $G_W$ will indicate this state, and the lower 12 bits will then equal the amount out-of-gamut. These values are set to zero if the corresponding color is not out of gamut.

Next, a feathering function value is calculated from a feathering function labeled WOOG. Several ways of producing feathering function WOOG are possible. WOOG may be calculated as the average of ROOG and GOOG, as shown in Table 6. Other embodiments may employ other linear combinations of the red and green. For example, it may be desirable to weigh green more than red since green contributes more to the luminance of a pixel than red. This feathering function may have a peak at yellow and may fall off in a non-linear fashion in all directions, possibly reaching zero at cyan and magenta. Other feathering functions might be desirable, for example one that falls linearly and does not reach zero until meeting at blue.

Figure 9:
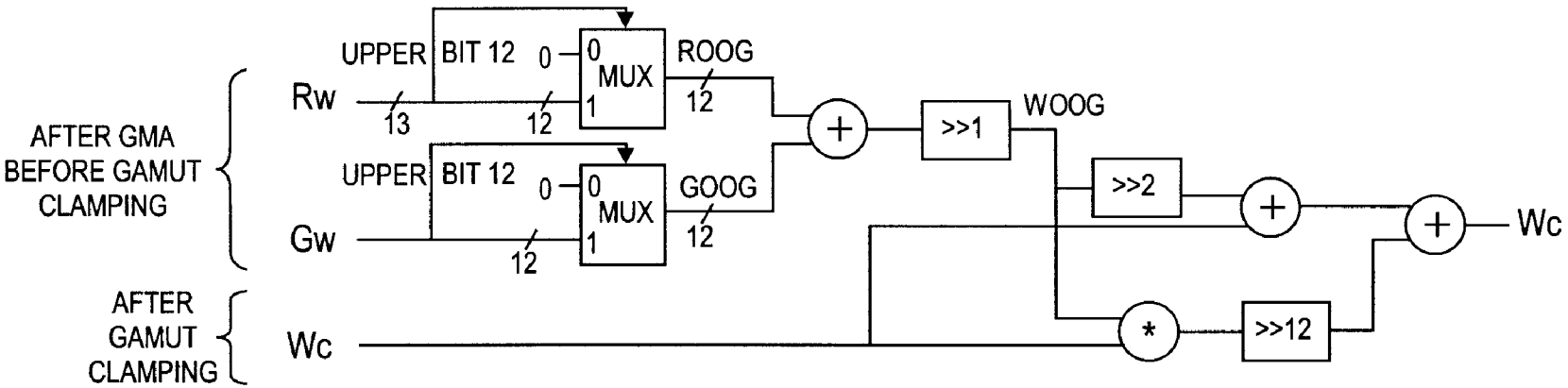
FIG. 9 is a diagram illustrating one embodiment of a fourth bypass module for a simplified gamut mapping operation.

Finally, the WOOG feathering value may be used to calculate a final $W_C$ value. Although calculations other than the one shown above are possible, this function may cause W to start increasing before approaching yellow from the "dark" directions, then scale the bright W values so that there are substantially no discontinuities. The calculation shown above is one such function. FIG. 9 shows one possible embodiment of a hardware diagram of this yellow de-saturate function based on the pseudo-code in Table 6.

Line YD on FIG. 10 shows the behavior of yellow de-saturate for a narrow line of colors between black, yellow and white. The yellow de-saturate pseudo-code above may also work correctly with all other input colors. The WOOG calculation prevents the yellow de-saturate function from modifying inappropriate colors, and a separate feathering function is not necessary.

While the techniques and implementations have been described with reference to exemplary embodiments, it will be understood by those skilled in the art that various changes may be made and equivalents may be substituted for elements thereof without departing from the scope of the appended claims. In addition, many modifications may be made to adapt a particular situation or material to the teachings without departing from the essential scope thereof. Therefore, the particular embodiments, implementations and techniques disclosed herein, some of which indicate the best mode contemplated for carrying out these embodiments, implementations and techniques, are not intended to limit the scope of the appended claims.

What is claimed is:

1. In an multi-primary display system, said display system including a metamer selection module, a method for determining a color value indicating a metamer color of a first color; the first color being defined by color values in at least first, second, third and fourth primary colors; the method comprising:

calculating an offset quantity, the offset quantity being a function of a distance in a color space between a maximum value of the first, second and third primary color values and the fourth primary color value of the first color so that the offset quantity varies depending on the fourth primary color value of the first color;

adding the offset quantity to the fourth primary color value of the first color to produce a modified fourth primary color value; and subtracting the offset quantity from the first, second and third primary color values of the first color to produce modified first, second and third primary color values; the modified first, second, third and fourth primary color values indicating the metamer color.

2. The method of claim 1 wherein the fourth primary color is one of white, grey and yellow.

3. The method of claim 1 wherein the first, second, third and fourth primary colors are red, green, blue and white.

4. The method of claim 1 wherein the offset quantity is half of the distance in the color space between a maximum value of the first, second and third primary color values and the fourth primary color value of the first color.

5. The method of claim 1 wherein calculating the offset quantity further includes limiting the offset quantity to the minimum of the offset quantity and a minimum of one of the color values in the first, second and third primary colors.

6. In a multi-primary display system for displaying colors specified by color values in at least first, second, third and fourth primary colors, the display system including a gamut mapping module for performing a gamut mapping operation converting an input color in an input color gamut to an output color in a display color gamut defined by the at least first, second, third and fourth primary colors, a method for modifying primary color values of the output color produced by the gamut mapping operation; the method comprising:

computing a value of an output color modifying function identifying a plurality of input colors for which the output color produced by the gamut mapping operation is to be modified;

testing the value of the output color modifying function to determine whether the input color is one of the plurality of input colors for which the output color produced by the gamut mapping operation is to be modified; and calculating a modified primary color value for at least one of the primary color values of the output color using the value of the output color modifying function, wherein the output color modifying function uses the primary color values of the input color to identify input colors approaching darker surfaces of the input color gamut or lying near brighter surfaces of the input color gamut as the plurality of input colors for which the output color is to be modified, and wherein the modified primary color value is the same as the primary color value when the output color modifying function has a predetermined value.

7. The method of claim 6 wherein the calculating a modified primary color value further includes calculating each of the modified primary color values.

8. The method of claim 6 wherein the calculating a modified primary color value further includes calculating only the modified white primary color value.

9. The method of claim 6 wherein the gamut mapping operation produces an output clamped color; and wherein the output color modifying function uses primary color values of the output clamped color to identify yellow input colors as the plurality of input colors for which the output color is to be modified.

10. The method of claim 9 wherein the step of calculating the modified primary color value for at least one of the primary color values of the output color includes calculating only the modified white primary color value.

11. The method of claim 6, wherein the input colors approaching the darker surfaces of the input color gamut are between black and saturated colors in the input color gamut.

12. The method of claim 6, wherein the input colors approaching the brighter surfaces of the input color gamut are between white and saturated colors in the input color gamut.

13. In a multi-primary display system for displaying colors specified by color values in at least first, second, third and fourth primary colors, the display system including a gamut mapping module for performing a gamut mapping operation converting an input color in an input color gamut to an output color in a display color gamut defined by the at least first, second, third and fourth primary colors, a method for modifying primary color values of the output color produced by the gamut mapping operation; the method comprising:

determining whether the gamut mapping operation produced an output color having color values outside the display color gamut defined by the at least first, second, third and fourth primary colors;

when the gamut mapping operation has produced an output color, calculating a first primary out-of-gamut quantity and a second primary out-of-gamut quantity;

computing a value of an output color modifying function using the first and second out-of-gamut quantities; and calculating a modified primary color value for at least one of the primary color values of the output color using the value of the output color modifying function, wherein the first and second out-of-gamut quantities are calculated by testing a first input color value and a second input color value against the maximum color values that the first and second color values are respectively capable of having in gamut.

14. The method of claim 13 wherein the step of calculating the modified primary color value for at least one of the primary color values of the output color includes calculating only the modified white primary color value.

15. The method of claim 13 wherein the step of determining whether the gamut mapping operation produced an output color having color values outside the display color gamut defined by the at least first, second, third and fourth primary colors tests yellow output colors.

* * * * *